US006406142B1

(12) United States Patent
Sato et al.

(10) Patent No.: US 6,406,142 B1
(45) **Date of Patent: *Jun. 18, 2002**

(54) IMAGE FORMING PROCESS USING A TRANSFER MEDIUM HAVING A SUPPORT WITH AN INDEX

(75) Inventors: Yuko Sato, Kawasaki; Masato Katayama, Yokohama; Masahiko Higuma, Togane; Yoshiyuki Shino, Kawasaki, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/121,686

(22) Filed: Jul. 24, 1998

(30) Foreign Application Priority Data

Jul. 26, 1997 (JP) ..... 9-215662
Jul. 26, 1997 (JP) ..... 9-215663

(51) Int. Cl.[7] ..... B41J 2/01; B41M 3/12

(52) U.S. Cl. ..... 347/103; 156/235; 156/240; 428/195; 428/913; 428/914; 430/256

(58) Field of Search ..... 347/102, 103, 347/105, 106; 428/195, 207, 324, 304.4, 913, 914, 201; 156/230, 235, 240, 277; 430/256; 101/33, 34

(56) References Cited

U.S. PATENT DOCUMENTS

| | | | | | |
|---|---|---|---|---|---|
| 3,985,602 | A | * | 10/1976 | Stuart | 156/235 |
| 4,007,835 | A | * | 2/1977 | Klothe | 206/411 |
| 4,032,687 | A | * | 6/1977 | Hornsby, Jr. | 428/1 |
| 4,564,406 | A | * | 1/1986 | Binks | 156/63 |
| 4,785,313 | A | | 11/1988 | Higuma et al. | 346/135.1 |
| 5,501,902 | A | | 3/1996 | Kronzer | 428/323 |
| 5,601,928 | A | | 2/1997 | Katayama et al. | 428/500 |
| 6,083,656 | A | * | 7/2000 | Hare et al. | 156/235 |
| 6,139,672 | A | * | 10/2000 | Sato et al. | 156/235 |
| 6,143,115 | A | * | 11/2000 | Sammis | 156/230 |

FOREIGN PATENT DOCUMENTS

| | | |
|---|---|---|
| EP | 0 461 796 A1 | 12/1991 |
| JP | 8-207426 | 8/1996 |
| JP | 8-207450 | 8/1996 |

* cited by examiner

*Primary Examiner*—Leslie J. Evanisko
(74) *Attorney, Agent, or Firm*—Fitzpatrick, Cella, Harper & Scinto

(57) ABSTRACT

Disclosed herein is a transfer medium for ink-jet recording adapted to form an image on a transfer layer thereof and then heat the transfer layer from the side of a support of the transfer medium to transfer the transfer layer to a transfer-printing medium, wherein an index is provided on the support.

2 Claims, 7 Drawing Sheets

IMAGE FORMING PROCESS USING A TRANSFER MEDIUM HAVING A SUPPORT WITH AN INDEX

BACKGROUND OF THE INVENTION

1. Field of the Invention

The present invention relates to a transfer medium suitable for use in forming an image on a medium to be transferred (hereinafter referred to as a "transfer-printing medium"), such as cloth or film, by transfer printing, and more particularly to a transfer medium for ink-jet recording, on the transfer layer of which an image is formed using an ink-jet recording system, and an image forming process using this transfer medium.

2. Related Background Art

An ink-jet recording system is intended to make a record of images, characters and the like by generating and ejecting fine droplets of an ink by any one of various ink ejection systems, for example, an electrostatic attraction system, a system in which a piezoelectric element is used to give an ink mechanical vibration or change, and a system in which an ink is heated to form bubbles in the ink so as to use the pressure thus produced, and applying part or all of the droplets to a recording medium such as paper. The ink-jet recording system attracts attention as a recording system which scarcely produces noise and can conduct high-speed printing and color printing.

In recent years, ink-jet printers, by which full-color printing can be simply conducted as described above, have been spread, and there has thus been an increasing demand for conducting color printing on various media using these printers. In order to meet such a demand, particular attention is paid to printing techniques using a transfer printing system in that printing can be conducted irrespective of the form of recording media, namely, the formation of an image can be performed on any medium which does not permit direct printing by a printer.

Some transfer media making good use of an ink-jet recording system have been proposed to date (for example, Japanese Patent Application Laid-Open No. 8-207426, Japanese Patent Application Laid-Open No. 8-207450, U.S. Pat. No. 5,501,902, etc.).

According to a transfer printing process using such a conventional transfer medium as described above, the desired image is first formed on a transfer layer of the transfer medium in accordance with an ink-jet system. The transfer medium and a transfer-printing medium such as cloth are then laid to overlap each other with the transfer layer, on which the image has been formed, on the side of the transfer-printing medium. In this state, both media are heated from the back side of the transfer medium to transfer the transfer layer to the surface of the transfer-printing medium, thereby forming the image on the transfer-printing medium. Such a transfer printing process is of course conducted industrially and often carried out in the home using a general-purpose household iron.

At this time, in order to successfully conduct the transfer printing, it is necessary to exactly heat the whole surface of the transfer layer. If a support is separated from the transfer layer while unheated portions or insufficiently heated portions are left at the transfer layer, there arises a problem that adhesion at these portions between the transfer layer and the transfer-printing medium such as cloth becomes insufficient, or that a part of the transfer layer remains on the support (for example, release paper), on which the transfer layer is supported, without achieving whole-surface transfer. Such incomplete transfer results in the fact that when the cloth having the incomplete transfer layer is laundered or otherwise rubbed, a part or the whole of the transfer layer is easily separated, or many cracks occur in the transfer layer to impair the quality of the image.

Besides, when the transfer printing is conducted at a low temperature, there arises a problem that adhesion between the transfer layer and the transfer-printing medium such as cloth becomes insufficient, or that a part of the transfer layer remains on the support (for example, release paper), on which the transfer layer is supported, without achieving whole-surface transfer. Such incomplete transfer results in the fact that when the cloth having the incomplete transfer layer is washed or otherwise rubbed, a part or the whole of the transfer layer is easily separated, or many cracks occur in the transfer layer to impair the quality of the image. On the other hand, when the transfer printing is conducted at a too high temperature, dyes which form the image are discolored, or the extreme case is that the cloth may also be discolored. Accordingly, the transfer printing requires to sufficiently heat the transfer layer at an optimum temperature that is not lower than a temperature, at which transfer can take place, but is not too high, in order for the materials, which form the transfer layer, to fully penetrate into interstices of the transfer-printing medium such as cloth throughout the transfer layer, whereby the transfer layer is transferred firmly to the cloth without causing discoloration of the dyes and transfer-printing medium.

In order to meet such requirements in the above-described transfer printing process, no particularly great problem arises in a heating step for transfer printing when the transfer printing using the transfer medium is performed industrially. When the transfer of the transfer layer is conducted by a household iron in the home, however, it is difficult to heat the whole back surface of the support corresponding to the area of the transfer layer even when the heating is conducted considerably carefully, since the area of the transfer layer is generally considerably wider than the area of the heating surface of the iron, and the heating is conducted from the side of the support opposite to the transfer layer. Accordingly, a problem that unheated portions remain in the transfer layer arises. In addition, since it is hard to say that the temperature of the heating surface of the household iron is even as a whole, and the temperature of the heating surface varies with the position, and moreover the temperature cannot be set precisely, even heating may not be performed in some cases even when the whole surface of the transfer layer is ironed, so that insufficiently heated portions remain. When the support is separated from the transfer layer in this state, the transfer layer transferred to the transfer-printing medium tends to separate or cracks to a great extent by washing or other rubbing, as described above.

SUMMARY OF THE INVENTION

It is an object of the present invention to provide a transfer medium for ink-jet recording, by which a transfer layer thereof can be easily heated throughout the whole surface thereof in a suitable state to transfer it to a transfer-printing medium such as cloth even when the step of transferring the transfer layer to the transfer-printing medium such as cloth is carried out in the home using a household iron or the like the heating surface of which is considerably narrower than the area of the transfer layer, to say nothing of a case where the step is industrially carried out, and which permits the simple formation of a high-quality image, and an image forming process using this transfer medium.

Another object of the present invention is to provide a transfer medium for ink-jet recording, which permits the simple formation of an image on a printing medium such as cloth, which does not permit direct ink-jet recording, in the home by using a general-purpose ink-jet recording apparatus and household iron without need of any particular apparatus, and the provision of a transferred image having excellent image properties and high fastness properties such as fastness to washing, and an image forming process using this transfer medium.

The above objects can be achieve by the present invention described below.

According to the present invention, there is thus provided a transfer medium for ink-jet recording adapted to form an image on a transfer layer thereof and then heat the transfer layer from the side of a support of the transfer medium to transfer the transfer layer to a transfer-printing medium, wherein an index is provided on the support.

According to the present invention, there is also provided an image forming process comprising the steps of forming an image on the transfer layer of the transfer medium for ink-jet recording described above in accordance with an ink-jet system, laying the transfer medium and a transfer-printing medium to overlap each other with the transfer layer, on which the image has been formed, on the side of the transfer-printing medium, and heating the transfer layer from the side of the support of the transfer medium to transfer the transfer layer of the transfer medium to the surface of the transfer-printing medium, wherein the heating is carried out by utilizing the index provided on the support.

According to the present invention, the index which indicates the position to be heated is provided on the support. Therefore, heat can be fully applied throughout the whole surface of the transfer layer of the transfer medium even when a heating surface upon heating is narrower than the area of the transfer layer and varies in temperature with the position, for example, when the transfer step is carried out in the home using a household iron. As a result, the transfer layer can be simply transferred to a transfer-printing medium such as cloth with satisfactory results.

In particular, when the index provided on the support is provided as a linear index at interlinear intervals of at most a half of the width of the heating surface of the iron, the problem that unheated portions or insufficiently heated portions remain in the transfer layer can be solved, so that the transfer layer of the transfer medium can be transferred to a transfer-printing medium such as cloth with wholly satisfactory results.

Moreover, according to the present invention, when for example, heat-sensitive portions, the visual appreciation of which changes at a temperature somewhat higher than a preferred transfer temperature, are formed as an index on the back surface of the transfer medium, the transfer layer of the transfer medium can be easily transferred to a transfer-printing medium such as cloth in an appropriate state even when transfer printing is carried out in the home using, for example, a household iron that cannot suitably set and control its temperature to a particular temperature.

DESCRIPTION OF THE PREFERRED EMBODIMENTS

Figure 1:
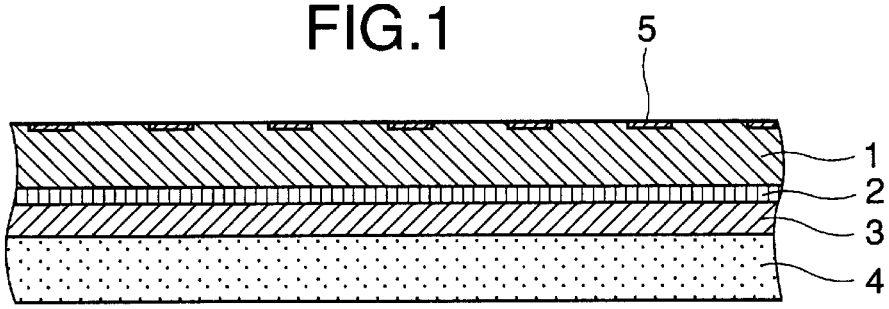
FIG. 1 is a schematic cross-sectional view illustrating a transfer medium according to an embodiment of the present invention.
Figure 2A:
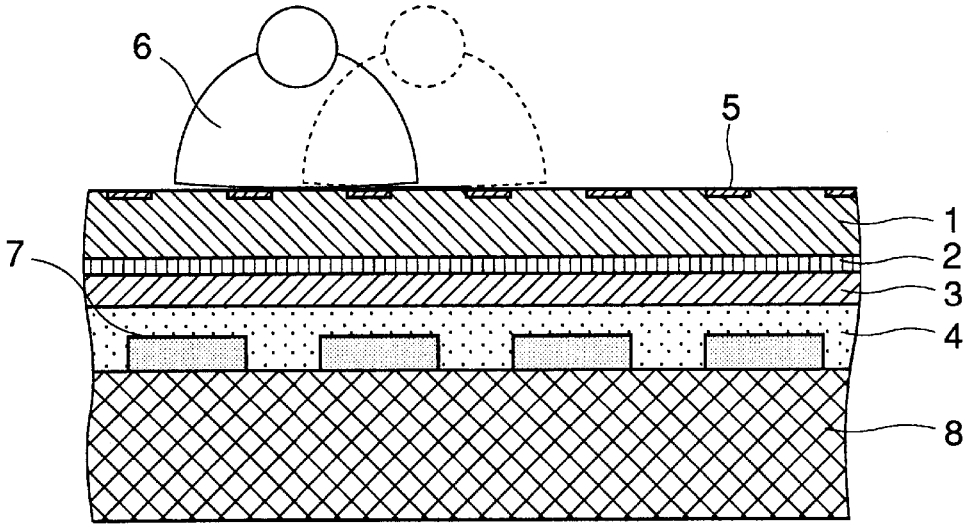
FIG. 2A graphically illustrates an image forming process using the transfer medium of FIG. 1.

As illustrated in section in FIG. 1, the transfer medium for ink-jet recording according to an embodiment of the present invention includes a releasing layer 2 and a transfer layer 4 both provided on a support 1, and an index 5 (see FIGS. 3A to 3G for the patterns thereof) for permitting suitably applying heat to the transfer layer 4 provided on the surface of the support 1. The transfer medium of such constitution according to the present invention is used in a case where the desired image 7 is formed on the transfer layer 4 in accordance with an ink-jet system, a transfer-printing medium 8 such as cloth is then placed on the transfer layer 4, and they are heated and pressed by, for example, a household iron 6 from the side of the support 1 as illustrated in FIG. 2A to transferring the transfer layer 4 to the cloth 8, thereby forming an image on the transfer-printing medium. Since the transfer medium for ink-jet recording according to the present invention is provided with the index 5 for permitting suitably applying heat to the transfer layer 4 on the surface of the support 1, in this process, the transfer layer 4 of the transfer medium can be naturally heated reliably and evenly by only conducting ironing along the index 5 even when any person carries out the heating. As a result, the transfer layer 4 of the transfer medium may be transferred to the transfer-printing medium 8 such as cloth with ease and reliability even when the transfer step is carried out using any of various household irons 6 or the like, the heating surface of which is narrower than the whole area of the transfer layer 4 and varies in temperature with the position.

In FIGS. 1 and 2A, an example where a transparent film layer 3 is provided between the releasing layer 2 and the transfer layer 4 is illustrated. However, it is not essential in the present invention to provide such a film layer 3. However, the provision of such a film layer 3 is preferred, since the film layer 3 functions as a protective layer for a transferred image after completion of the transfer printing.

Figure 2B:
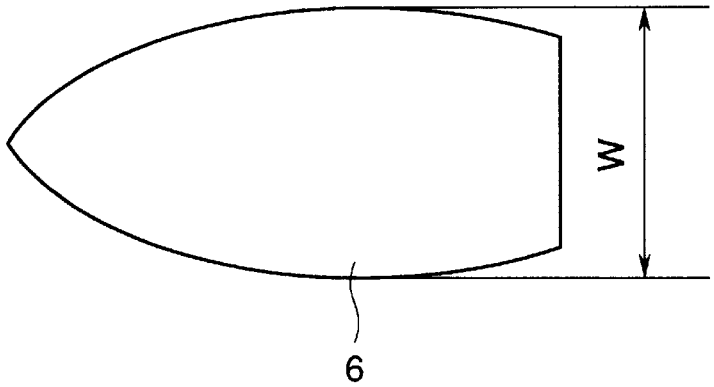
FIG. 2B shows a heating surface of a household iron used in FIG. 2A.
Figure 3A:
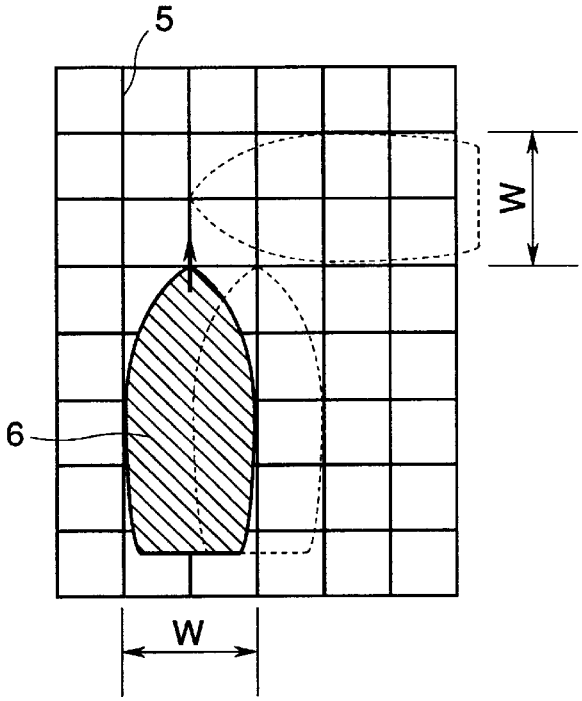
FIGS. 3A, 3B, 3C, 3D, 3E, 3F and 3G illustrate exemplary patterns of an index provided on the back surface of the transfer medium according to the present invention.

Examples of the pattern of the index 5 provided on the surface of the support 1 for permitting suitably heating the surface of the support, said index 5 principally featuring the transfer medium for ink-jet recording according to the present invention, are illustrated in FIGS. 3A to 3G. For example, an example illustrated in FIG. 3A is an example where a linear index 5 in the form of grid is provided on the surface of the support 1 by printing or the like. In this example, heating by an iron is conducted along a plurality of lines arranged regularly in a transverse direction and/or in a vertical direction. An interval between adjacent vertical lines or horizontal lines is preferably narrower than a maximum transverse width W (hereinafter referred to as the "width W" merely) of the heating surface of an iron used. If the interval is wider than the width W of the iron used as shown in FIG. 2B, there is a possibility that unheated portions may remain upon heating. The example illustrated in FIG. 3A is a preferred example where the interval between the lines provided as indices has been preset to about a half of the width W of the iron. More specifically, when ironing is carried out along the linear index 5 in the form of grid, it results in naturally heating the same place of the transfer layer, which is located on the side opposite to the heating surface of the iron, repeatedly twice even when any person carries out the heating. Therefore, no unheated area remains. Even if the heating surface varies in temperature with the position, no insufficiently heated area remains, since first and second heating is conducted by different parts of the heating surface. As a result, the transfer layer is transferred to a transfer-printing medium such as cloth with satisfactory results, so that a high-quality transferred image having high fastness is formed.

Figure 3B:
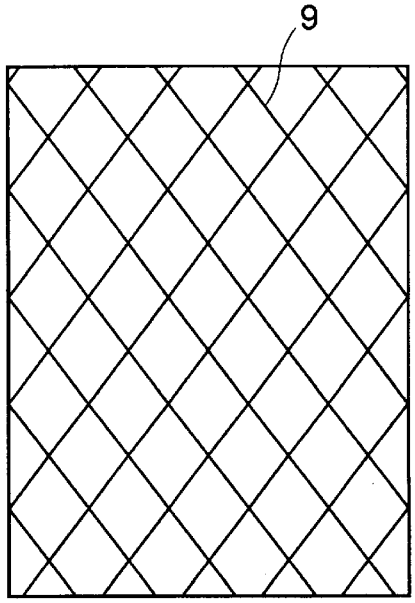
Figure 3C:
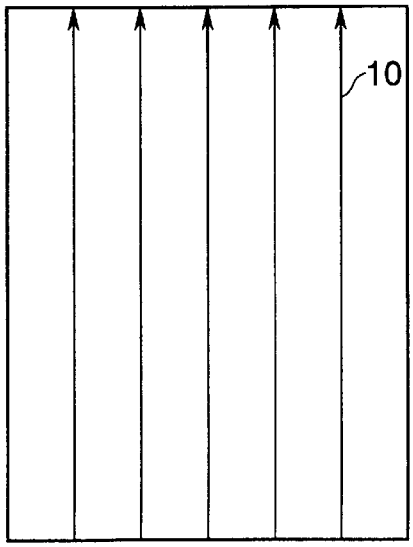
Figure 3D:
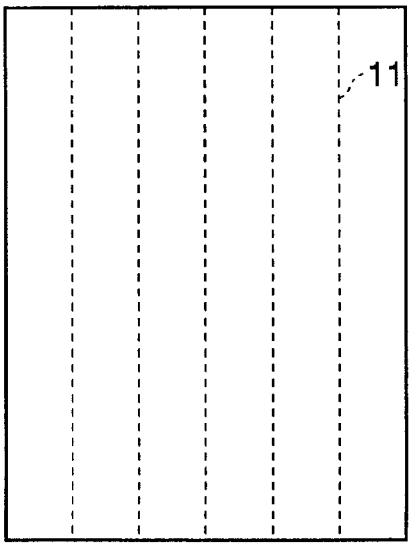
Figure 3E:
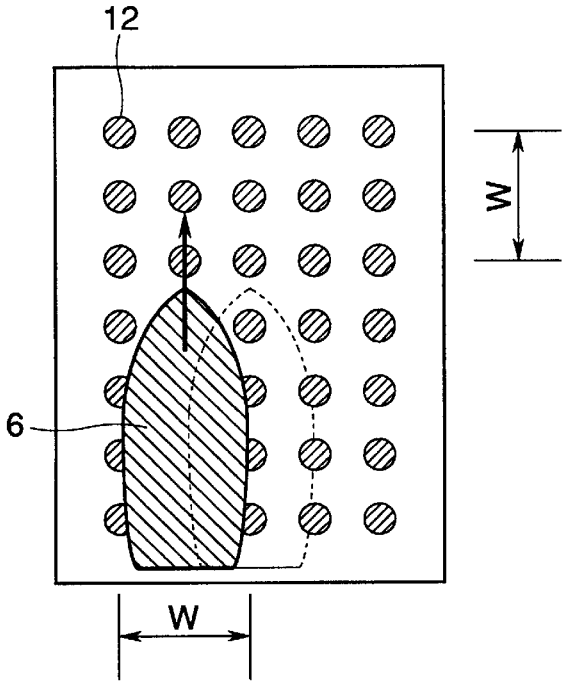
Figure 3F:
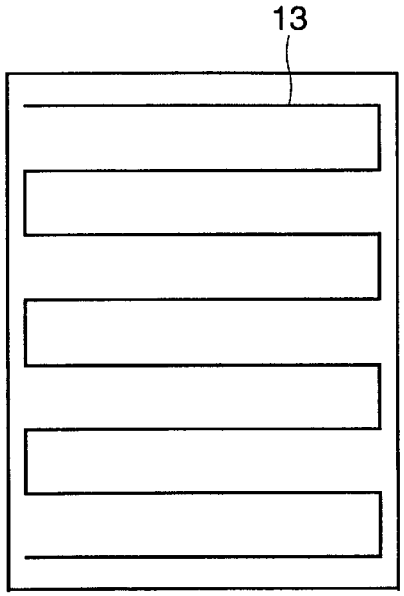
Figure 3G:
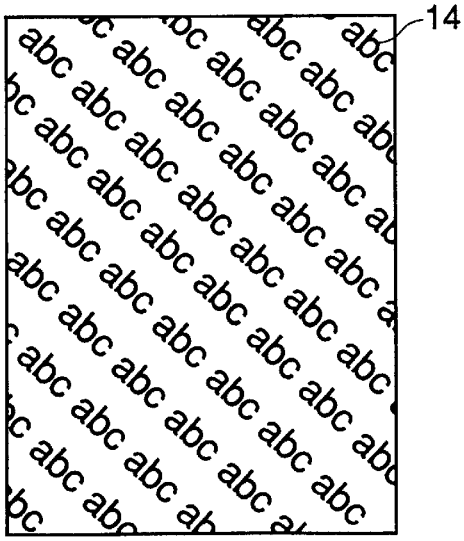

The interval between the index lines may be a half of the width of the iron as illustrated in FIG. 3A. However, when the interval is preset narrower than the half in such a manner that when an iron is placed on adjacent index lines, a part of the heating surface of the iron surely overlaps the previously heated area, i.e., the index lines are provided at intervals of, for example, at most 1/2.2 of the width of the iron, it is ensured that the transfer layer can be heated repeatedly at least twice at the whole area thereof when the heating is conducted along the index lines by the iron. However, it is not that the narrower the interval, the better the result. If the interval between the index lines is too narrow, it takes a long time to conduct transfer printing. The most preferable interval between the index lines in the transfer medium according to the present invention is of the order of from 1/3 to 1/2.2 of the width of an iron used. Examples illustrated in FIGS. 3B to 3G are versions of the index 5 illustrated in FIG. 3A and have the same action and effect as those in FIG. 3A. An index 9 illustrated in FIG. 3B is formed by slant lines to edges of a support 1. An index 10 illustrated in FIG. 3C is formed by arrows. An index 11 illustrated in FIG. 3D is formed by broken lines arranged regularly. An index 12 illustrated in FIG. 3E is formed by dots. An index 13 illustrated in FIG. 3F is formed by a polygonal line. An index 14 illustrated in FIG. 3G is formed by characters arranged regularly. The mere ironing along these indices 9 to 14 ensures that the whole surface of the transfer layer of the transfer medium according to the present invention can be heated all over.

In the present invention, the index having such a form as described above may be formed by printing such an index pattern with a usual printing ink on the surface of a support. Inks usable at this time are limited to inks that neither melt at a transfer temperature nor stick to a heating means such as an iron. Accordingly, it is preferred to use inks prepared by using, as a vehicle, a resin having good heat resistance and, preferably, excellent lubricity.

Examples of a process for forming the index 5 on the surface of the support 1 include a process in which a coloring material such as a dye or pigment, a vehicle resin as a film-forming material, and other necessary additives are dissolved or dispersed in a suitable solvent to prepare an ink, and an index pattern is printed with the ink on the surface of the support 1, and the like. Examples of the printing method include methods such as lithography, offset litho printing, letterpress printing, gravure printing and screen printing.

Figure 4:
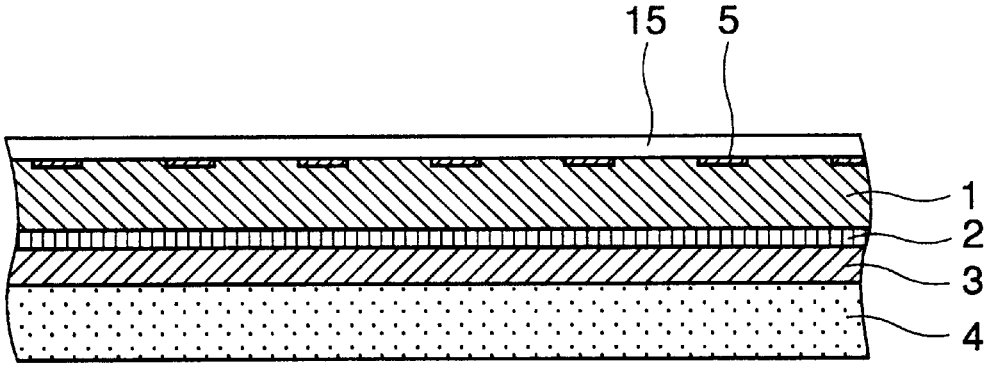
FIG. 4 is a schematic cross-sectional view illustrating a transfer medium according to another embodiment of the present invention.
Figure 5:
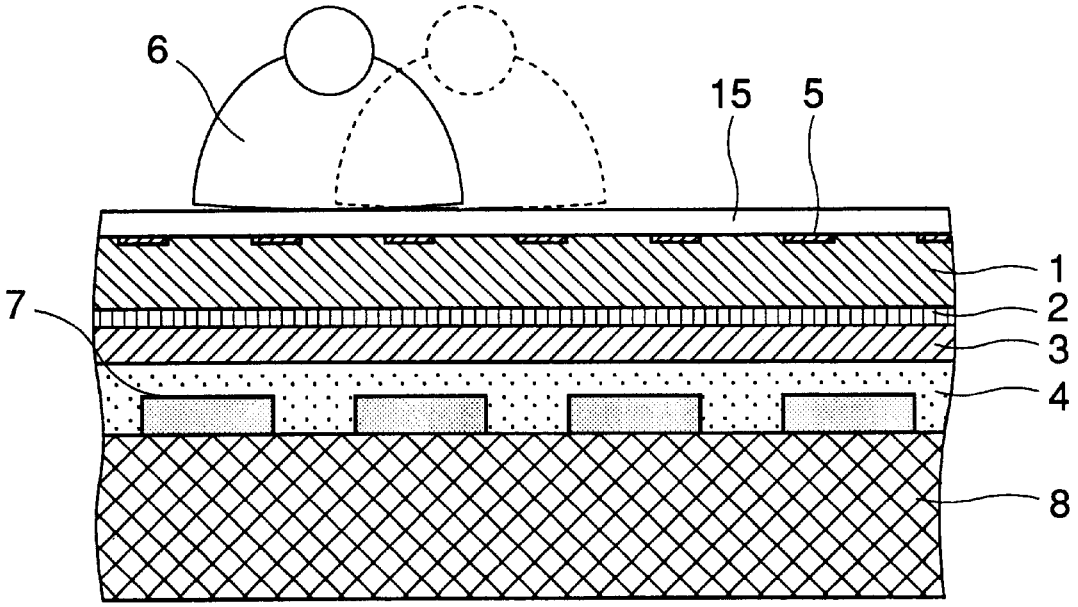
FIG. 5 graphically illustrates a process of transferring the transfer medium of FIG. 4.

The transfer medium for ink-jet recording according to another preferred embodiment of the present invention is illustrated in FIGS. 4 and 5. In the transfer medium illustrated herein, an index 5 of the same pattern as described above is provided on the surface of a support 1, and moreover a transparent protective layer 15 is provided on the surface of the index 5. It is preferred that the protective layer 15 provided at this time is transparent, has sufficient heat resistance to transfer a transfer layer and can protect the surface of the index when the transfer medium is stored or shipped.

Preferred examples of a material for forming this heat-resistant protective layer 15 include resins which neither melt nor stick when it is heated by an iron or the like, for example, acrylic resins such as polymethyl methacrylate, polycarbonate resins, aromatic polyester resins, aromatic polyamide resins, polyimide resins, silicone resins, and fluororesins. Examples of particularly preferred resins in the present invention include silicone resins, fluororesins, and block copolymers of a silicone or fluororesin and any other resin, which have a silicone or fluororesin segment. No particular limitation is imposed on the coating weight thereof. However, about 0.1 to 2 $g/m^2$ suffices for it. The example where the protective layer 15 has been formed as a uniform film on the surface of the index 5 has been described above. However, the present invention is not limited to this. For example, it may also be allowable to form the index 5 by a means such as printing and then impregnate the support 1 with the resin described above, thereby forming the protective layer 15 on the surface of the index 5.

No particular limitation is imposed on the specific features such as forms and materials of formation as to other components, such as the support 1, releasing layer 2 and transfer layer 4, in the transfer media for ink-jet recording according to the present invention, which have the index on the surface of the support 1. They may be formed in any conventionally-known way. For example, a transfer medium, in which a transfer layer 4 thereof is formed from a thermoplastic resin, a crystalline plasticizer and a tackifier as described in Japanese Patent Application Laid-Open No. 8-207426, may be allowable. A transfer layer 4 may be formed with a particulate thermoplastic resin, inorganic porous fine particles and a binder so as to permit ink-jet printing as described in Japanese Patent Application Laid-Open No. 8-207450. As described in U.S. Pat. No. 5,501,902, a transfer layer 4 may be formed by adding a cationic resin, an ink-viscosity adjuster and the like in addition to the above-described components. In the present invention, it is particularly preferred that the transfer layer 4 be formed as a porous layer from fine particles of a water-insoluble thermoplastic resin and a water-insoluble thermoplastic resin binder, or more preferably from these resins, and a plasticizer for at least one of these resins or inorganic fine particles or a cationic resin. The individual materials for forming a preferred transfer layer in the transfer media for ink-jet recording according to the present invention will hereinafter be described specifically.

As the water-insoluble thermoplastic resin used in forming the transfer layer 4 in the present invention, there are used porous fine particles of a thermoplastic resin. When such fine particles of the thermoplastic resin are contained in the transfer layer, they are present in the transfer layer with the shape as the fine particles retained as they are, without forming a film before the formation of a transfer image, so that the transfer layer becomes a porous layer. Therefore, when inks are applied to the transfer layer in accordance with an ink-jet recording system, the inks can be satisfactorily absorbed in voids defined by the fine particles and retained therein. When the porous fine particles of the thermoplastic resin are used in this case, the inks are also absorbed in pores in the fine particles, so that the ink absorbency of the transfer layer can be more enhanced. When an image formed on the transfer layer is brought into contact with a transfer-printing medium, and they are heated and pressed from the side of the support of the transfer medium, thereby transferring the image to the transfer-printing medium, the fine particles of the thermoplastic resin in the transfer layer are melted and transferred to the transfer-printing medium, and these fine particles are also formed into a film. As a result, it is possible to satisfactorily fix coloring materials to the transfer-printing medium such as cloth or film.

Such fine particles of the thermoplastic resin as described above are preferably used in an amount ranging from about 30% by weight to about 90% by weight based on the total weight of the transfer layer.

As the fine particles of the thermoplastic resin preferably used as a material for forming the transfer layer 4 in the present invention, any fine particles may be used so far as they are fine particles formed of a water-insoluble thermoplastic resin. Specific examples of such a thermoplastic resin include polyethylene, polypropylene, polyvinyl acetate, water-insoluble polyvinyl alcohol, polyvinyl acetal, copolymers of poly(meth)acrylic acid, poly(meth)acrylates, polyacrylic acid derivatives, polyacrylamide, polyether, polyester, polycarbonate, cellulosic resins, polyacrylonitrile, polyimide, polyamide (nylon), polyvinyl chloride, polyvinylidene chloride, polystyrene, Thiokol, polysulfone, polyurethane and copolymers of monomers of these resins. Among others, polyethylene, polypropylene, the copolymers of poly(meth)acrylic acid, poly(meth)acrylates, polyvinyl acetate, polyvinyl chloride, polyurethane, polyamide (nylon) and copolymers of monomers thereof are more preferably used.

The particle size of the fine particles of the thermoplastic resin used in the present invention is preferably within a range of from 0.05 $\mu$m to 100 $\mu$m, more preferably from 0.2 $\mu$m to 50 $\mu$m, most preferably from 5 $\mu$m to 20 $\mu$m from the viewpoints of the ink absorbency of the resulting transfer layer and the clearness of the resulting image. If resin particles having a particle size smaller than 0.05 $\mu$m are used, interparticle voids become too small upon the formation of the transfer layer, and so the resulting transfer layer comes to have insufficient ink absorbency. Further, if the particles are too small, the smoothness of the surface of the resulting transfer layer becomes high, so that the transfer layer becomes hard to penetrate into the fibers of cloth, and an image transferred to the cloth tends to be formed as an even continuous film on the surface of the cloth. As a result, the transferred image becomes easy to be separated, and the transfer layer cracks to expose the underlying fibers when the cloth is stretched. Therefore, it is difficult to provide any satisfactory transferred image. If fine particles of the thermoplastic resin having a particle size greater than 100 $\mu$m are used on the other hand, the resolution of the resulting image becomes low, so that any clear image is difficult to be provided.

In particular, when the porous fine particles of the thermoplastic resin are used in the transfer layer 4 in the present invention, the ink absorbency of the transfer layer can be more enhanced as described above, so that a greater amount of ink can be absorbed in a thinner layer thickness, resulting in a thin transfer layer which permits the formation of a clear image. Further, such provision of the thin transfer layer not only permits transferring the resulting image with more ease, but also makes hand of the image transferred on cloth or the like soft, so that a more preferable cloth with the transferred image can be provided when transferring the transfer layer 4. When fine particles of a thermoplastic resin composed of a copolymer of a monomer of nylon 6 and a monomer of nylon 12 are used as the material for forming the transfer layer 4, the coloring ability of dyes becomes better, and so a clearer image can be provided.

As a material for the fine particles of the thermoplastic resin used in the present invention, there is preferably used a material capable of being sufficiently melted by a household iron or the like so as to be able to simply transfer an image formed on the resulting transfer layer by means of a general-purpose ink-jet printer to cloth in the home or the like. Taking this regard into consideration, a resin having a melting point ranging from 70° C. to 200° C., preferably from 80° C. to 180° C., more preferably from 100° C. to 150° C. is suitably used as the material for the fine particles of the thermoplastic resin. More specifically, when a material for the fine particles of the thermoplastic resin having a melting point lower than 70° C. is used, the fine particles of the thermoplastic resin in the transfer layer may possibly form a continuous film according to conditions where the resulting transfer medium is shipped or stored. After coating the support with the fine particles of the thermoplastic resin, it is necessary to dry the coating film at a temperature lower than the melting point of the fine particles of the thermoplastic resin. It is thus preferred to use the thermoplastic resin having a melting point of at least 70° C. for the purpose of facilitating the drying from the viewpoint of production efficiency. On the other hand, if a material for the fine particles of the thermoplastic resin having a melting point higher than 200° C. is used, higher energy is required for transferring the resulting image to cloth. It is hence difficult to simply form a transferred image on a printing medium such as cloth or film.

Taking the adhesion of the transfer layer 4 to the cloth into consideration, it is also preferred to use a material for the fine particles of the thermoplastic resin having a low melt viscosity. When a resin having a high melt viscosity is used, the adhesion between the resulting transfer layer and cloth becomes poor, so that the transfer layer 4 in the form of a continuous film is easy to be separated. On the contrary, when a material having a low melt viscosity is used, the transfer layer become easy to penetrate into fibers upon transfer printing, thereby providing a good transferred image wherein the color of the underlying fibers is not exposed even when the cloth is stretched after the transfer printing.

The thermoplastic resin binder, which is used as a material for forming the transfer layer 4 together with the fine particles of the thermoplastic resin, is added for the purpose of bonding the fine particles of the thermoplastic resin to one another to form a film, thereby forming the transfer layer 4, and of fixing the transfer layer, on which an image has been formed, to cloth upon transfer printing. In the present invention, as with the fine particles of the thermoplastic resin, any conventionally known water-insoluble thermoplastic resin may be used as the thermoplastic resin binder. Specifically, the same thermoplastic resins as those mentioned above as the materials for the fine particles of the thermoplastic resin may be used as the binder.

Such a thermoplastic resin binder as described above is preferably used in an amount ranging from 10% by weight to 70% by weight based on the total weight of the transfer layer.

In the present invention, a weight ratio of the fine particles of the thermoplastic resin to the thermoplastic resin binder is preferably within a range of from 1/2 to 50/1, more preferably from 1/2 to 20/1, most preferably from 1/2 to 15/1. If the proportion of the fine particles of the thermoplastic resin is too high, adhesion among the fine particles of the thermoplastic resin or between the fine particles and the releasing layer becomes insufficient, and it is hence impossible to form a transfer layer having sufficient strength before its transfer. On the other hand, if the proportion of the fine particles of the thermoplastic resin is too low, it is difficult to provide any transfer layer 4 having excellent ink absorbency and permitting the formation of an image having excellent clearness.

When the transfer layer 4 of the transfer medium for ink-jet recording according to the present invention is formed by the above-described two materials alone, no problem arises when the melting point or softening point of the fine particles of the thermoplastic resin or thermoplastic resin binder is relatively low. However, when such a melting point or softening point is high, the resulting transfer layer may not be sufficiently transferred in some cases. In the present invention, therefore, it is preferred to add a plasticizer for the fine particles of the thermoplastic resin or a plasticizer for the thermoplastic resin binder as a material for forming the transfer layer 4.

By adding these plasticizer, the melt viscosity of the transfer layer can be made low upon transfer of the resulting image, i.e., upon heating of the transfer layer, and moreover the adhesion of the transfer layer to cloth can be more enhanced to improve the transferability thereof. In addition, the use of the plasticizer permits imparting strength and flexibility to the resulting transfer image, and so it is possible to form a transferred image having an excellent hand on a printing medium such as cloth or film.

The above-described plasticizer is preferably used in an amount ranging from about 1% by weight to about 20% by weight based on the total weight of the transfer layer.

Preferable examples of the plasticizer used in this case include phthalates such as diethyl phthalate, dioctyl phthalate, dimethyl phthalate and dibutyl phthalate, phosphates such as tributyl phosphate and triphenyl phosphate, adipates such as octyl adipate and isononyl adipate, sebacates such as dibutyl sebacate and dioctyl sebacate, acetyltributyl citrate, acetyltriethyl citrate, dibutyl maleate, diethylhexyl maleate, dibutyl fumarate, trimellitic acid type plasticizers, polyester type plasticizers, epoxy type plasticizers, stearin type plasticizers, paraffin chloride, toluenesulfonamide and derivatives thereof, and 2-ethylhexyl p-hydroxybenzoate.

When the transfer medium for ink-jet recording according to the present invention is used to conduct transfer printing on a porous transfer-printing medium, for example, cloth or the like, it is preferred to further add inorganic particles to the transfer layer. When inorganic particles are added to the transfer layer, a problem that when the transfer layer, on which an image has been formed, is transferred to the cloth or the like, the optical density of the image is lowered because the transfer layer penetrates into the cloth in excess, and coloring materials also penetrate deeply, and a problem that when the cloth having the transferred image is washed, the surface of the cloth is fuzzed, and the optical density of the image is lowered by the same factor can be prevented in advance. More specifically, the addition of the inorganic particles having no melt property under heat to the transfer layer can prevent the thermoplastic resin making up the transfer layer from penetrating into the cloth in excess, so that a film can be formed on the surface of the cloth, and a clear image having high optical density can hence be provided. After that manner, fibers are also bonded on the surface of the cloth, and so the cloth can be prevented from being fuzzed by its washing, whereby the cloth can be provided as a cloth carrying a transferred image having high fastness to washing.

The above-described inorganic particles are preferably used in an amount ranging from about 0.1% by weight to about 20% by weight based on the total weight of the transfer layer.

No particular limitation is imposed on the inorganic particles used in the present invention so far as they are porous and have good ink absorbency. Specific examples thereof include silica, aluminum silicate, magnesium silicate, hydrotalcite, calcium carbonate, titanium oxide, clay, talc and (basic) magnesium carbonate.

Of these, a material having high dyeing property may preferably be used, since a dye in an ink is fixed to a portion nearer the surface of the cloth. When a material having a higher void volume is used in this case, the ink absorbency of the resulting transfer layer is also enhanced, and so a clearer image can be provided. The particle size of the inorganic particles used in the present invention is preferably equal to that of the fine particles of the thermoplastic resin described above as much as possible. The reason for it is that when particles different in particle size are added to each other, particles having a smaller diameter are filled in interparticle voids of particles having a greater diameter, so that the voids of the resulting transfer layer are reduced.

In the present invention, a cationic resin may be added to the materials for forming the transfer layer. The addition of the cationic resin permits the provision of a transferred image having higher fastness properties. More specifically, coloring materials commonly used in ink-jet printers are dyes. Such a coloring material is taken together into the transfer layer when the fine particles of the thermoplastic resin and the binder are melted by heat upon transfer printing, and fixed to a transfer-printing medium such as cloth or film.

However, the film thus formed may not become completely even in some case. In such a case, the dye may exude when the cloth is immersed in water upon, for example, washing. When the cationic resin is added to the transfer layer, however, it reacts with the dye to insolubilize the dye, so that the dye can be prevented from dissolving out.

The above-described cationic resin is preferably used in an amount ranging from about 1% by weight to about 20% by weight based on the total weight of the transfer layer.

Examples of cationic resins preferably used in this case include cationically modified products of resins such as polyvinyl alcohol, hydroxyethyl cellulose and polyvinyl pyrrolidone; polymers and copolymers of amine monomers such as allylamine, diallylamine, allyl sulfone, dimethylallyl sulfone and diallyldimethylammonium chloride, and of acrylic monomers having a primary, secondary or tertiary amine, or quaternary ammonium base at their side chains, such as dimethylaminoethyl (meth)acrylate, diethylaminoethyl (meth)acrylate, methylethylaminoethyl (meth)

acrylate, dimethylamino-styrene, diethylaminostyrene, methylethylaminostyrene, N-methylacrylamide, N-dimethylacrylamide, N,N-diemthyl-aminoethyl methacrylamide and quaternized compounds thereof; and resins having a primary, secondary or tertiary amine, or quaternary ammonium base at their main chains, such as dicyanamide.

The film thickness of the transfer layer formed by such materials as described above is preferably within a range of from 10 to 150 $\mu$m, more preferably from 30 to 120 $\mu$m, most preferably from 40 to 100 $\mu$m. If the transfer layer is too thick, any flexible transferred image cannot be provided when the transfer layer is transferred to a transfer-printing medium such as cloth. If the transfer layer is too thin on the other hand, a transferred image to be formed becomes deteriorated in image quality or fastness properties. It is hence not preferred to form the transfer layer in such a too thick or thin thickness.

A surfactant may also be contained in the transfer layer in the transfer medium for ink-jet recording according to the present invention for the purpose of improving its permeability to inks. More specifically, when the surfactant is added into the transfer layer, the wettability of the surfaces of the particles contained in the transfer layer is improved, and so the permeability to water-based inks is enhanced. As the surfactant used in the present invention, any of nonionic surfactants commonly used may be used. More specifically, surfactants of the ether, ester, ether-ester and nitrogen-containing types may be used.

The transfer medium for ink-jet recording according to the present invention has a releasing layer 2 together with the transfer layer formed in the above-described manner. The presence of the releasing layer allows the transfer layer having the excellent properties to be easily transferred to a transfer-printing medium such as cloth or film. For example, a problem that when the support is separated and removed from cloth after the transfer layer is transferred to the cloth by heating and pressing, the transfer layer is separated together from the cloth, or a part of the transfer layer remains on the support without being transferred, so that the image is impaired is prevented.

A material for such a releasing layer 2 formed on the support for the purpose of facilitating the separation of the transfer layer from the support when the transfer layer is transferred to the printing medium such as cloth or film is preferably a hot-melt material. Specific examples thereof include waxes such as carnauba wax, paraffin wax, microcrystalline wax and castor wax, higher fatty acids and derivatives thereof such as metal salts and esters, for example, stearic acid, palmitic acid, lauric acid, aluminum stearate, lead stearate, barium stearate, zinc stearate, zinc palmitate, methyl hydroxystearate and glycerol monohydroxystearate, polyamide resins, petroleum resins, rosin derivatives, coumarone-indene resins, terpene resins, novolak resins, styrene resins, olefin resins such as polyethylene, polypropylene, polybutene and polyolefin oxide, and vinyl ether resins. Besides, silicone resins, fluorosilicone resins, fluoroolefin-vinyl ether copolymers, perfluoroepoxy resins, thermosetting acrylic resins having perfluoroalkyl groups at their side chains, and vinylidene fluoride type hardening resins may also be used.

In a further embodiment of the present invention, as illustrated in FIGS. 1 and 2A and so on, the transfer medium for ink-jet recording according to the present invention may be provided with a film layer 3 between the transfer layer 4 and the releasing layer 2, both described above, to form a transfer layer composed of two layers. The provision of this film layer 3 has the following two advantages.

First, the transfer layer 4 can be formed on the releasing layer 2 with more easy. In the transfer medium for ink-jet recording according to the present invention, as described above, it is preferred to provide the porous transfer layer 4 for the purpose of improving its ink absorbency. When the porous layer is provided on a layer having low adhesion, such as the releasing layer 2, however, the adhesion between these layers becomes poor, so that in some cases, the transfer layer 4 may separate from the releasing layer 2 upon handling of the resulting transfer medium. Accordingly, when a transfer layer is provided as a layer of the two-layer structure in such a manner that a film layer 3, which is formed with a material different from that for the fine resin particles of the original transfer layer 4, is located on the transfer layer 4 on the side of the releasing layer 2, the adhesion between the transfer layer 4 and the releasing layer 2 is improved, and so the above problem is hard to arise.

Second, when the film layer 3 is provided between the transfer layer 4 and the releasing layer 2, the fastness to washing of an image transferred to cloth or the like can be more improved. More specifically, when the transfer layer is provided as a layer of the two-layer structure, the film layer 3 becomes a face layer to cover the surface of an image formed after transfer printing. Therefore, the coloring materials are closely fixed to the cloth in a state that they are more shielded in the transfer layer, and the fastness properties are hence enhanced.

It is preferred that a material of the same kind as the above-described thermoplastic resin binder used as a material for forming the transfer layer be used as a material for forming the film layer 3. More specifically, when materials of the same kind are used as materials for forming these two layers, adhesion between the two layers can be enhanced, and so the fastness properties of the image transferred can be more improved. Further, since a difference in refractive index between the two layers becomes small, the transfer layer after transfer printing become transparent, and so a clear image can be provided. The transfer layer 4 is porous due to the action of the fine particles contained therein, while the film layer 3 is not porous. The thickness of the film layer 3 is preferably made thinner than the transfer layer 4, e.g., within a range of the order of from 1 to 50 $\mu$m.

Figure 6:
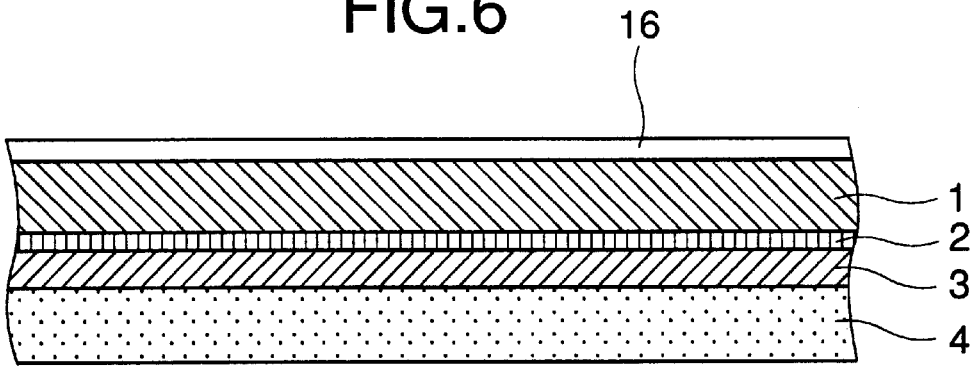
FIG. 6 is a schematic cross-sectional view illustrating a transfer medium according to a further embodiment of the present invention.
Figure 7:
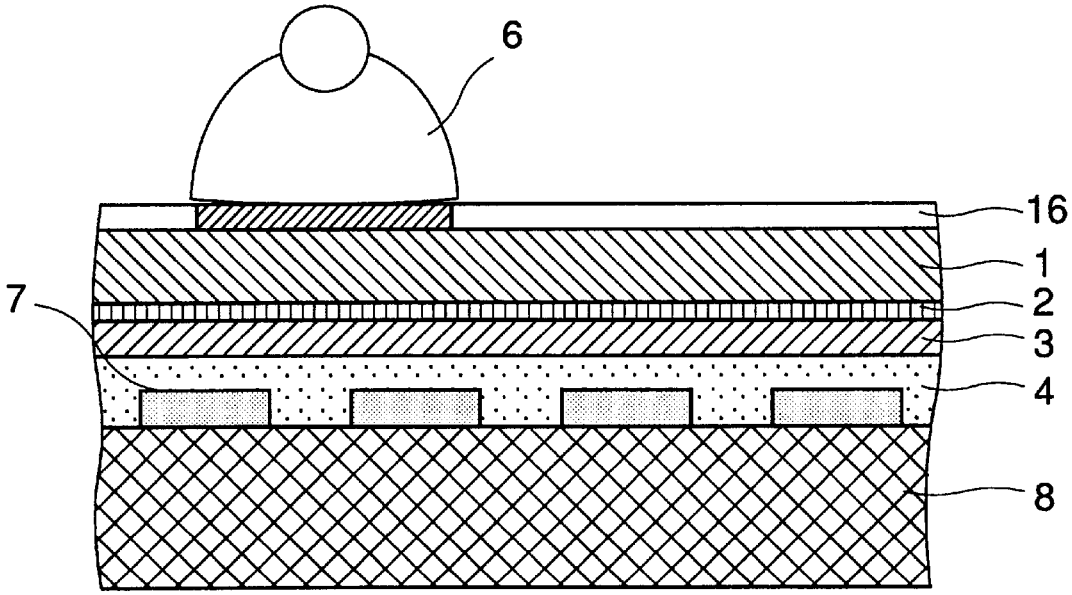
FIG. 7 graphically illustrates a process of transferring the transfer medium of FIG. 6.

The transfer medium for ink-jet recording according to the present invention as illustrated in FIG. 6 includes an index 16, the visual appreciation, such as color, of which changes by heating upon transfer printing, provided on the surface of a support 1. The transfer medium of such constitution according to the present invention is used in a case where the desired image 7 is formed on a transfer layer 4 in accordance with an ink-jet system, a transfer-printing medium 8 such as cloth is then placed on the transfer layer 4, and they are heated and pressed by, for example, a household iron 6 from the side of the support 1 as illustrated in FIG. 7 to transferring the transfer layer 4 to the cloth, thereby forming a transferred image. In this case, since the transfer medium for ink-jet recording according to the present invention is provided with the index 16 which is a heat-sensitive part that is preset in such a manner that the visual appreciation thereof changes when a sufficient temperature to firmly transfer the transfer layer 4 to the cloth is applied thereto, whether a sufficient temperature to transfer the transfer layer 4 is applied to the transfer layer 4 can be judged by change in visual appreciation appeared on the index 16. As a result, the transfer layer 4 of the transfer medium can be transferred to the transfer-printing medium 8 such as cloth with ease and reliability even when transfer printing is carried out in the home using, for example, a household iron that cannot suitably set and control its temperature to a particular temperature.

As a material for the index 16 illustrated in FIG. 6, there may preferably be used the so-called temperature indicating material the visual appreciation of which changes according to temperature change. The temperature indicating material itself is a known material, and any of irreversible, quasi-irreversible and reversible temperature indicating materials may be used. Of these, the irreversible temperature indicating material is particularly preferably used in order to clearly grasp the state of transfer.

Examples of the irreversible temperature indicating material include various kinds of temperature indicating materials the visual appreciation of which clearly changes according to physical or chemical change, such as thermal decomposition system, sublimate development system, chemical reaction system, melt development system, electron transfer system and pH change system. Specific examples of temperature indicating materials used in the present invention include salts of metals such as cobalt, nickel, iron, copper, chromium and manganese, mixtures of two kinds of coloring matter different in hue, one of which sublimates at a specific temperature, mixtures of bismuth oxide and bismuth sulfide, materials the visual appreciation of which changes by melting, dispersions of a leuco dye and a phenolic compound (heat-sensitive color-developing dyes), and mixture of an organic acid and phenolphthalein.

The above-described examples are preferred examples, and besides various kinds of coloring matter, which are conventionally known dyes and pigments the visual appreciation of which changes at a temperature somewhat higher than the transfer temperature may also be used.

In the present invention, the heat-sensitive index 16 is formed on the surface of a support using such a temperature indicating material as described above. Coatings and printing inks containing the temperature indicating material are also known, and these temperature indicating coatings or inks may be used. However, coatings or inks usable in the present invention are limited to those in which a vehicle that neither melts at a transfer temperature nor sticks to a heating means such as an iron is used. Accordingly, it is preferred to use temperature indicating coatings or inks prepared by using a resin having good heat resistance and, preferably, excellent lubricity as a vehicle together with any of the conventionally-known temperature indicating materials described above.

The transfer temperature of the transfer layer 4 is generally designed to be of the order of from 100° C. to 250° C. in such a manner that the transfer layer 4 can be easily formed into a film and transferred using a household iron. Therefore, it is preferred that a temperature indicating material, the visual appreciation of which changes at a temperature higher than the transfer temperature by about 10 to 50° C., for example, at 110 to 300° C., be used upon the formation of the heat-sensitive index 16. In such a manner, an area of the transfer layer that has not been heated at the transfer temperature or higher can be easily distinguished with the naked eyes. More specifically, since the transfer layer can be heated in the transfer step while visually observing the state of change in color at the heat-sensitive part, the whole surface of the transfer layer 4 can be heated with ease at an optimum transfer temperature. When an irreversible temperature indicating material is used, it is only necessary to observe the heat-sensitive part after the heating and reheat an area that has undergone no color change, if any, until the area undergoes color change. As a result, the transfer layer 4 situated on the side opposite to the heat-sensitive part can be evenly heated, so that the transfer layer 4 can be transferred with good results and high reliability.

Figure 8:
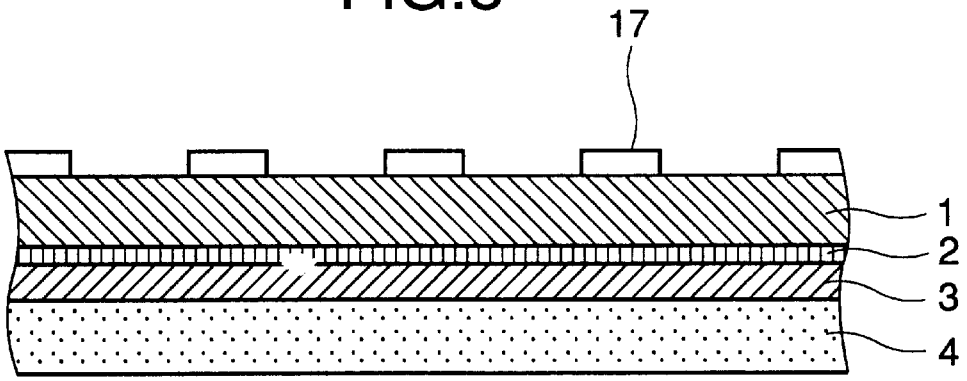
FIG. 8 is a schematic cross-sectional view illustrating a transfer medium according to a still further embodiment of the present invention.
Figure 9:
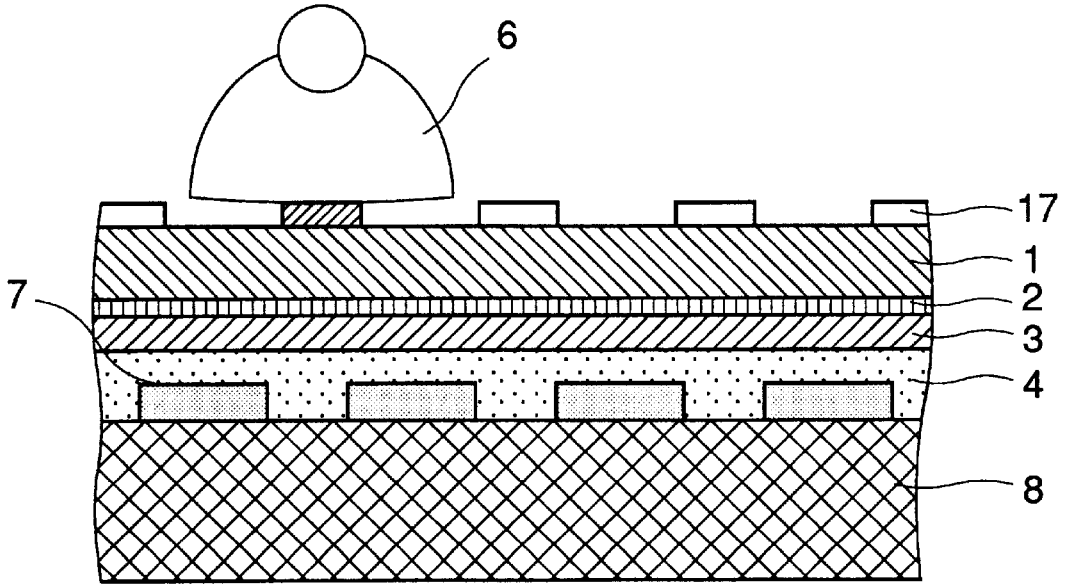
FIG. 9 graphically illustrates a process of transferring the transfer medium of FIG. 8.

As illustrated in FIGS. 6 and 7, the index 16 having the excellent effect described above is preferably formed so as to have an area equal to or greater than the transfer layer 4 opposite thereto. It is more preferred that the index 16 be formed in solid all over the surface of the support. However, the present invention is not limited to this form, and the index may be provided at an irreducible minimum of position sufficient to confirm whether the whole surface of the transfer layer is heated. For example, a heat-sensitive index 17 may be formed on the pattern of lines or dots at an interval narrower than the width of an iron as illustrated in FIGS. 8 and 9. In such a manner, a user can apply an optimum transfer temperature all over the whole surface of the transfer layer 4 of the transfer medium with reliability by heating the transfer layer 4 using a household iron while controlling the temperature relying upon the color change of the index 17.

No particular limitation is imposed on the thickness of such a heat-sensitive index as described above, and the mere thickness that color change can be visually confirmed with ease suffices. In all the examples described above, the index is provided on the surface of the support 1 on the side not facing the releasing layer 2 on which the transfer layer 4 is provided. However, the present invention is not limited to this arrangement, and the index may be provided at any position so far as the index can be easily observed from the side of the releasing layer 2 opposite to the transfer layer 4 upon transferring to the transfer-printing medium 8. For example, when a transparent material is used for the support 1, the index may be formed on the surface of the support 1 on the side of the releasing layer 2.

Processes for forming the heat-sensitive index on the surface of the support include a process in which the preferred temperature indicating material described above, a vehicle resin, and other necessary additives are dissolved or dispersed in a suitable solvent to prepare a coating formulation or ink, and the coating formulation or ink is applied to the surface of a support by coating or printing, a process in which a film is formed with these materials, and the film is laminated on a support, and a process in which a film is extruded on a support. Examples of the coating method include a roll coater, blade coater, air knife coater, gate roll coater, bar coater, size pressing, Symsizer, spray coating, gravure coating and curtain coater methods. Examples of the printing method include methods such as lithography, offset litho printing, letterpress printing, gravure printing and screen printing.

Figure 10:
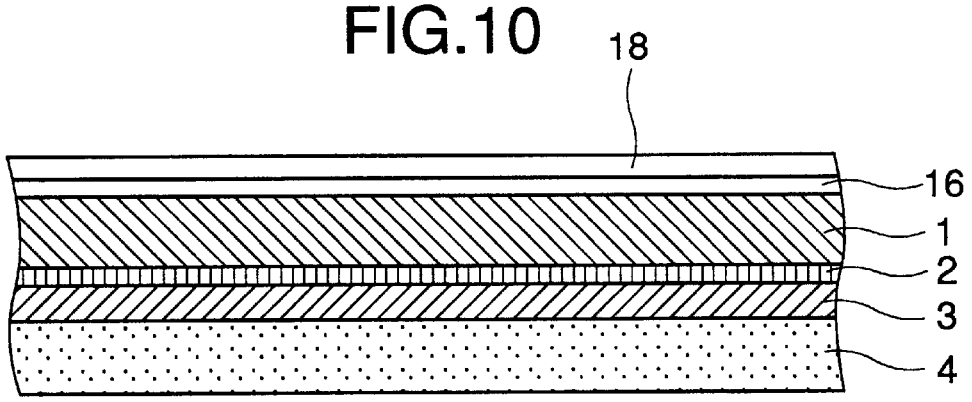
FIG. 10 is a schematic cross-sectional view illustrating a transfer medium according to a yet still further embodiment of the present invention.
Figure 11:
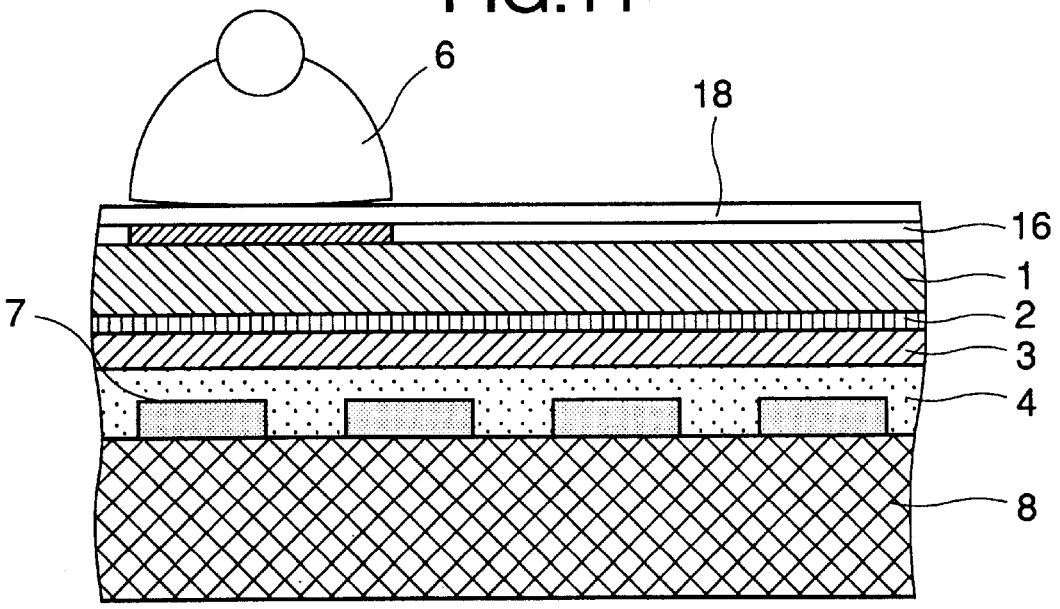
FIG. 11 graphically illustrates a process of transferring the transfer medium of FIG. 11.

A still further preferred embodiment of the present invention is illustrated in FIGS. 10 and 11. In the transfer medium according to this embodiment, the same heat-sensitive index 16 as described above is provided on the surface of a support 1, and a transparent protective layer 18 is provided on the surface of the index 16. The protective layer 18 provided in this case is the same as the protective layer 15 described above.

Incidentally, the same Reference numerals have the same meaning throughout FIGS. 1 to 11.

The transfer media for ink-jet recording according to the present invention, which have such respective features as described above, are used for the purpose of forming an image on the transfer layer in accordance with an ink-jet recording system and transferring the image formed by a means such as heating to a transfer-printing medium (recording medium), on which an image is difficult to directly form by the ink-jet recording system, such as cloth or film, thereby forming an image on the cloth or the like. As an ink-jet printer, any commercially available ink-jet printer commonly used may be employed as it is. No particular limitation is also imposed on coloring materials to be used. Conventionally known anionic coloring materials may be used. It is not necessary to specially change the kinds of coloring materials according to materials making up cloth.

Materials on which an image will be formed using the transfer medium for ink-jet recording according to the present invention include cloth, film and the like. In particular, the cloth is preferably used. No particular limitation is imposed on materials making up the cloth used in the present invention. Examples thereof include cotton, hemp, silk, wool, rayon, polyester, nylon, acrylic, acetate, triacetate, polyurethane, and blended fibers thereof. The cloth may be used in any form of a woven fabric, a knitted fabric and a nonwoven fabric.

The image forming process according to the present invention comprises the steps of forming an image on the transfer layer of the transfer medium described above in accordance with an ink-jet system, laying the transfer medium and a transfer-printing medium to overlap each other with the transfer layer, on which the image has been formed, on the side of the transfer-printing medium, and heating the transfer layer from the side of the support of the transfer medium to transfer the transfer layer of the transfer medium to the surface of the transfer-printing medium, wherein the heating is carried out by utilizing the index provided on the support. The process of the present invention is particularly useful when using a household iron the heating surface of which is narrower than the whole area of the transfer layer of the transfer medium.

The present invention will hereinafter be described more specifically by the following Examples and Comparative Example. It goes without saying that the present invention is not limited to these examples. Incidentally, all designations of "part" or "parts" and "%" as will be used in the following examples mean part or parts by weight and % by weight unless expressly noted.

EXAMPLE 1

Release paper (ST-60 OKT, trade name, product of Lintec Corp.) on one side of which a releasing layer had been provided was used as a support, and a grid pattern having a line thickness of 0.5 mm at interlinear intervals of 45 mm as illustrated in FIG. 3A was printed on the other side (the side on which no releasing layer had been provided) of the support by offset printing to form an index.

A coating formulation having the following composition was applied to the release layer-provided side (the side opposite to the index-printed side) of the releasing paper, on which the index had been provided, by a bar coater method, so as to give a dry coating thickness of 50 μm, and dried at 70° C. for 10 minutes in a drying oven to form a transfer layer, thereby producing a transfer medium according to this example.

[Composition of Coating Formulation for Transfer Layer]

- Ethylene-vinyl acetate copolymer emulsion (Chemipearl V-300, trade name, product of Mitsui Petrochemical Industries, Ltd.; solids content: 40%; particle size: 6 μm;)
  137.5 parts (solids content: 55 parts)
- Ethylene-acrylic acid copolymer emulsion (Hitec E-8778, trade name, product of Toho Chemical Industry Co., Ltd.; solids content: 25%)
  180 parts (solids content: 45 parts)
- Silica particles (Mizukasil P-78A, trade name, product of Mizusawa Industrial Chemicals, Ltd.; particle size: 3 μm;) 0.6 parts
- Acrylic cationic resin (EL Polymer NWS-16, trade name, product of Shin-Nakamura Chemical Co., Ltd.; solids content: 35%)
  6.8 parts (solids content: 2.4 parts).

EXAMPLE 2

After a grid pattern was printed on one side of a support in the same manner as in Example 1 to form an index, a coating formulation having the following composition was applied to the printed side of the support by a bar coater method, so as to give a dry coating weight of 3 g/m$^2$, and dried at 80° C. for 1 minute in a drying oven to form a surface protective layer for the index. [Composition of Coating Formulation for Protective Layer]

- Polydimethylsiloxane (TPR-6711, trade name, product of Toshiba Silicone Co., Ltd.; solids content: 30%)
  333 parts (solids content: 100 parts)
- Catalyst (CM670, trade name; product of Toshiba Silicone Co., Ltd.) trace amount
- Toluene 200 parts.

A coating formulation having the following composition was applied to the release layer-provided side (the side opposite to the index-printed side) of the releasing paper, on which the index had been provided, by a bar coater method, so as to give a dry coating thickness of 50 μm, and dried at 70° C. for 10 minutes in a drying oven to form a transfer layer, thereby producing a transfer medium according to this example. [Composition of Coating Formulation for Transfer Layer]

- Porous nylon particles (Orgasol 3501EXD NAT, trade name, product of Elf Atochem S.A.; particle size: 10 μm) 55 parts
- Ethylene-acrylic acid emulsion (Hitec E-8778, trade name, product of Toho Chemical Industry Co., Ltd.; solids content: 25%)
  180 parts (solids content: 45 parts)
- N-Ethyl-o,p-toluenesulfonamide (Topcizer No. 3, trade name, product of Fuji Amide Chemical Co., Ltd.; solids content: 30%)
  33 parts (solids content: 10 parts)
- Silica particles (Mizukasil P-78A, trade name, product of Mizusawa Industrial Chemicals, Ltd.; particle size: 3 μm;) 2 parts
- Cationic resin (EL Polymer NWS-16, trade name, product of Shin-Nakamura Chemical Co., Ltd.; solids content: 35%)
  23 parts (solids content: 8 parts)
- Fluorine-containing surfactant (Surflon S-131, trade name, product of Seimi Chemical Co., Ltd.; solids content: 30%;)
  3 parts (solids content: 1 part)
- Isopropyl alcohol 40 parts.

EXAMPLE 3

An index in the form of grid was formed on releasing paper in the same manner as in Example 2, and a coating formulation having the following composition was applied to the release layer-provided side (the side opposite to the index-printed side) of the releasing paper, on which the index had been provided, by a bar coater method, so as to give a dry coating thickness of 20 μm, and dried at 70° C. for 10 minutes in a drying oven to form a film layer.

[Composition of Coating Formulation for Film Layer]

Porous nylon particles (Orgasol 3501EXD NAT, trade name, product of Elf Atochem S.A.; particle size: 10 μm) 0.1 parts Ethylene-acrylic acid emulsion (Hitec E-8778, trade name, product of Toho Chemical Industry Co., Ltd.; solids content: 25%)
400 parts (solids content: 100 parts)

Isopropyl alcohol 5 parts.

A transfer layer was then formed in the same manner as in Example 2 on the film layer provided on the release paper, thereby producing a transfer medium according to this example.

EXAMPLE 4

Paper for PPC having a basis weight of 64 g/m$^2$ was used as a support, and a vinyl monofluoride resin film having a thickness of 20 μm was laminated on one side of this support to form a releasing layer. A grid pattern having a line thickness of 0.5 mm at interlinear intervals of 45 mm as illustrated in FIG. 3A was printed on the other side (the side on which no releasing layer had been provided) of the support by offset printing to form an index.

A coating formulation having the following composition was applied to the release layer-provided side (the side opposite to the index-printed side) of the releasing paper, on which the index had been provided, by a bar coater method, so as to give a dry coating thickness of 40 μm, and dried at 60° C. for 10 minutes in a drying oven to form a transfer layer, thereby producing a transfer medium according to this example.

[Composition of Coating Formulation for Transfer Layer]

Ethylene-vinyl acetate copolymer emulsion (Chemipearl V-300, trade name, product of Mitsui Petrochemical Industries, Ltd.; solids content: 40%; particle size: 6 μm;)
250 parts (solids content: 100 parts)

Polyvinyl alcohol (PVA-217, trade name, product of Kuraray Co., Ltd.; 20% aqueous solution)
50 parts (solids content: 10 parts).

EXAMPLE 5

A releasing layer was provided on a support composed of paper for PPC in the same manner as in Example 4. A grid pattern having a line thickness of 0.5 mm at interlinear intervals of 45 mm as illustrated in FIG. 3A was printed on the other side (the side on which no releasing layer had been provided) of the support by offset printing to form an index.

A coating formulation having the following composition was applied to the release layer-provided side (the side opposite to the index-printed side) of the releasing paper, on which the index had been provided, by a bar coater method, so as to give a dry coating thickness of 40 μm, and dried at 60° C. for 10 minutes in a drying oven to form a transfer layer, thereby producing a transfer medium according to this example.

[Composition of Coating Formulation for Transfer Layer]

Ethylene-vinyl acetate copolymer emulsion (Chemipearl V-300, trade name, product of Mitsui Petrochemical Industries, Ltd.; solids content: 40%; particle size: 6 μm;)
250 parts (solids content: 100 parts)

Polyvinyl alcohol (PVA-217, trade name, product of Kuraray Co., Ltd.; 20% aqueous solution)
50 parts (solids content: 10 parts)

Polyallylamine hydrochloride (PAA-HCl-10L, trade name, product of Nitto Boseki Co., Ltd.; solid content: 40%)
12 parts (solids content: 4.8 parts)

Benzalkonium chloride (G50, trade name, product of Sanyo Chemical Industries, Ltd.; solids content: 50%)
6 parts (solids content: 3 parts).

EXAMPLE 6

Release paper (ST-60 OKT, trade name, product of Lintec Corp.) on one side of which a releasing layer had been provided was used as a support, and solid printing was conducted with Thermopaint No. 16 (trade name, product of Nichiyu Giken K.K.) on the whole surface of the back side (the side on which no releasing layer had been provided; the same shall apply hereinafter) of the support by screen printing to form a heat-sensitive index on the whole surface of the back side of the releasing paper.

The same coating formulation for transfer layer as that used in Example 2 was applied to the release layer-provided side (the side opposite to the index-printed side) of the releasing paper, on which the index had been provided, by a bar coater method, so as to give a dry coating thickness of 50 μm, and dried at 70° C. for 10 minutes in a drying oven to form a transfer layer, thereby producing a transfer medium according to this example.

EXAMPLE 7

A grid pattern having a line thickness of 0.5 mm at interlinear intervals of 45 mm was printed with Thermopaint No. 16 (trade name, product of Nichiyu Giken K.K.) on the back side of the same releasing paper as that used in Example 6 to form a heat-sensitive index in the form of grid. A transfer layer was provided on the release layer-provided side (the side opposite to the index-printed side) of the releasing paper, on which the index had been provided, in the same manner as in Example 6, thereby producing a transfer medium according to this example.

EXAMPLE 8

The back side of the same releasing paper as that used in Example 6 was subjected to printing in the same manner as in Example 7 to form a heat-sensitive index in the form of grid. The same coating formulation for film layer as that used in Example 3 was applied to the release layer-provided side (the side opposite to the index-printed side) of the releasing paper, on which the index had been provided, by a bar coater method, so as to give a dry coating thickness of 20 μm, and dried at 70° C. for 10 minutes in a drying oven to form a film layer.

A transfer layer was then formed in the same manner as in Example 6 on the film layer provided on the release paper, thereby producing a transfer medium according to this example.

EXAMPLE 9

Paper for PPC having a basis weight of 64 g/m$^2$ was used as a support, and a vinyl monofluoride resin film having a thickness of 20 μm was laminated on one side of this support to form a releasing layer. Solid printing was then conducted with Thermopaint No. 14 (trade name, product of Nichiyu Giken K.K.) on the whole surface of the back side of the release paper, on which the releasing layer had been provided, by screen printing to form a heat-sensitive index on the whole surface of the back side of the releasing paper. The same coating formulation for protective layer as that used in Example 2 was further applied to the index-printed side of the releasing paper by a bar coater method, so as to give a dry coating weight of 3 g/m$^2$, and dried at 80° C. for 1 minute in a drying oven to form a surface protective layer.

The same coating formulation for transfer layer as that used in Example 1 was applied to the release layer-provided side of the releasing paper, on which the index and surface protective layer had been provided, by a bar coater method, so as to give a dry coating thickness of 50 $\mu$m, and dried at 70° C. for 10 minutes in a drying oven to form a transfer layer, thereby producing a transfer medium according to this example.

EXAMPLE 10

A transfer medium according to this example, in which a surface protective layer was provided on a heat-sensitive index in the form of grid, was produced in the same manner as in Example 9 except that a grid pattern having a line thickness of 0.5 mm at interlinear intervals of 45 mm was printed with Thermopaint No. 14 (trade name, product of Nichiyu Giken K.K.) on the back side of the same releasing paper as that prepared in Example 9 by screen printing.

EXAMPLE 11

Paper for PPC having a basis weight of 64 g/m$^2$ was used as a support, and a vinyl monofluoride resin film having a thickness of 20 $\mu$m was laminated on one side of this support to form a releasing layer. Solid printing was then conducted with Thermopaint No. 14 (trade name, product of Nichiyu Giken K.K.) on the whole surface of the back side of the release paper, on which the releasing layer had been provided, by screen printing to form a heat-sensitive index on the whole surface of the back side of the releasing paper.

The same coating formulation for transfer layer as that used in Example 4 was applied to the release layer-provided side (the side opposite to the index-printed side) of the releasing paper, on which the index had been provided, by a bar coater method, so as to give a dry coating thickness of 40 $\mu$m, and dried at 60° C. for 10 minutes in a drying oven to form a transfer layer, thereby producing a transfer medium according to this example.

EXAMPLE 12

A releasing layer was provided on a support composed of paper for PPC in the same manner as in Example 11. Solid printing was then conducted with Thermopaint No. 14 (trade name, product of Nichiyu Giken K.K.) on the whole surface of the back side of the release paper, on which the releasing layer had been provided, by screen printing to form a heat-sensitive index on the whole surface of the back side of the releasing paper.

The same coating formulation for transfer layer as that used in Example 5 was applied to the release layer-provided side (the side opposite to the index-printed side) of the releasing paper, on which the index had been provided, by a bar coater method, so as to give a dry coating thickness of 40 $\mu$m, and dried at 60° C. for 10 minutes in a drying oven to form a transfer layer, thereby producing a transfer medium according to this example.

COMPARATIVE EXAMPLE 1

A transfer layer was provided on the releasing layer-provided side of the same releasing paper (ST-60 OKT, trade name, product of Lintec Corp.) as that used in Example 1 in the same manner as in Example 1 to produce a transfer medium having no index.

The transfer temperatures of the transfer layers in Examples 6 to 12 and Comparative Example 1 and temperatures at which Thermopaints used in the formation of the heat-sensitive indices underwent color change are shown in Table 1.

TABLE 1

| | Transfer temperature of transfer layer | Color change temperature of Thermopaint |
|---|---|---|
| Example 6 | 160° C. | 180° C. |
| Example 7 | 160° C. | 180° C. |
| Example 8 | 160° C. | 180° C. |
| Example 9 | 120° C. | 160° C. |
| Example 10 | 120° C. | 160° C. |
| Example 11 | 120° C. | 160° C. |
| Example 12 | 120° C. | 160° C. |
| Comparative Example 1 | 160° C. | — |

[Evaluation]

Printing was conducted on the thus-produced transfer media of Examples 1 to 12 and Comparative Example 1 in accordance with a back printing film mode (reflected-image printing mode) by means of an ink-jet color printer, BJC-600 (trade name, manufactured by Canon Inc.) to form an image on the transfer layer of each transfer medium. The transfer media on which the image had been formed were used to make evaluation as to the following items.

(1) Evaluation as to Transferability (A)

Each 10 sheets of the transfer media of Examples 1 to 5 and Comparative Example 1 were used to form an image on all the sheets. Ten men and women different in age conducted tests to transfer each image of these transfer media to a 100% cotton T-shirt by means of a household iron. With respect to the transfer media according to Examples 1 to 5, they were instructed to conduct ironing along the index. The image-transferred T-shirts thus obtained were visually observed to evaluate the transfer media as to transferability. The iron used was an iron, TA-FZ2 (trade name, manufactured by Toshiba Corporation; width: 110 mm). The temperature of the iron was set to a dial of cotton on the iron, and the ironing time (transfer time) was about 2 minutes per A4-sized medium.

As a result, when the transfer media of Examples 1 to 5 were used, all the ten persons were able to beautifully transfer the whole surface of the transfer layer to the T-shirt. On the contrary, when the transfer medium of Comparative Example 1 was used, edge portions of the image were not fixed to the T-shirt in some cases, resulting in insufficient transfer.

(2) Evaluation as to Transferability (B)

Each 10 sheets of the transfer media of Examples 6 to 12 and Comparative Example 1, on which an image had been printed, were provided, and two persons conducted tests to transfer each image to a T-shirt (100% cotton) by means of each of 5 irons of different kinds. With respect to the transfer media according to Examples 6 to 12, they were instructed to conduct ironing until Thermopaint underwent color change.

The image-transferred T-shirts thus obtained were visually observed to evaluate the transfer media as to transferability.

As a result, when the transfer media of Examples 6 to 12 were used, the whole surface of the transfer layer was able to be beautifully transferred to all the ten T-shirts. On the contrary, when the transfer medium of Comparative Example 1 was used, edge portions of the image were not fixed to the T-shirt in some cases, resulting in insufficient transfer.

(3) Evaluation as to Fastness to Washing:

Each transferred sample obtained in the evaluation as to transferability was washed (by standard mode) in a washing machine to evaluate it as to fastness to washing. The washing machine used was NA-F60VP1 (trade name) manufactured by Matsushita Electric Industrial Co., Ltd.

The T-shirts on which the image was formed with each of the transfer media of Examples 1 to 12 involved no problem that the transfer layer is separated after the washing. On the contrary, some T-shirts on which the image was formed with the transfer medium of Comparative Example 1 involved a problem that the transfer layer is further separated after the washing.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming process comprising the steps of:

forming an image on a transfer layer of a transfer medium for ink-jet recording, using an ink-jet system, said transfer medium comprising a releasing layer and the transfer layer on a support, said support having an index comprising a regular pattern of a plurality of lines wherein an interval between two adjacent lines is narrower than the width of an iron, and said index being provided on the side of the support opposite the side carrying said releasing layer and said transfer layer;

laying the transfer medium and a transfer-printing medium to overlap each other with the transfer layer, on which the image has been formed, on the side of the transfer-printing medium; and heating the transfer layer from the side of the support of the transfer medium to transfer the transfer layer of the transfer medium to the surface of the transfer-printing medium, wherein the heating is conducted by the iron and carried out using the index provided on the support.

2. The image forming process according to claim 1, wherein the interval between the two lines is at most a half of the width of the iron.

* * * * *

UNITED STATES PATENT AND TRADEMARK OFFICE

CERTIFICATE OF CORRECTION

PATENT NO. : 6,406,142 B1
DATED : June 18, 2002
INVENTOR(S) : Yuko Sato et al.

It is certified that error appears in the above-identified patent and that said Letters Patent is hereby corrected as shown below:

Column 3,
Line 11, “achieve” should read -- achieved --.

Column 8,
Line 53, “become” should read -- becomes --.

Column 9,
Line 33, “these” should read -- this --.

Column 10,
Line 49, “case.” should read -- cases. --.

Column 11,
Line 3, “N,N-diemthyl-” should read -- N,N-dimethyl- --.
Line 40, “is” (first occurrence) should read -- that is --.

Column 12,
Line 2, “easy.” should read -- ease. --.
Line 17, “hard” should read -- unlikely --.
Line 37, “become” should read -- becomes --.
Line 63, “appeared” should read -- appearing --.

Column 16,
Lines 17 and 33, “[Composition of” should read -- ¶ [Composition of -- (no indent).

Signed and Sealed this

Fourth Day of February, 2003

JAMES E. ROGAN
*Director of the United States Patent and Trademark Office*